US007067043B1

(12) United States Patent
Giertz et al.

(10) Patent No.: US 7,067,043 B1
(45) Date of Patent: Jun. 27, 2006

(54) COKE OVEN DOOR WITH GAS CHANNEL

(75) Inventors: Hans-Josef Giertz, Ratingen (DE); Franz Liesewitz, Mülheim (DE); Friedrich-Wilhelm Cyris, Duisburg (DE); Frank Rossa, Bochum (DE)

(73) Assignee: Deutsche Montan Technologie GmbH, Essen (GB)

( * ) Notice: Subject to any disclaimer, the term of this patent is extended or adjusted under 35 U.S.C. 154(b) by 592 days.

(21) Appl. No.: 10/111,742

(22) PCT Filed: Oct. 20, 2000

(86) PCT No.: PCT/EP00/10324

§ 371 (c)(1),
(2), (4) Date: Apr. 25, 2002

(87) PCT Pub. No.: WO01/30939

PCT Pub. Date: May 3, 2001

(30) Foreign Application Priority Data

Oct. 26, 1999 (DE) ..... 199 51 467
Sep. 30, 2000 (DE) ..... 100 48 678

(51) Int. Cl.
*B01D 3/00* (2006.01)

(52) U.S. Cl. ..... 202/239; 202/222; 202/247; 202/248; 202/242; 202/243; 202/269

(58) Field of Classification Search ..... 202/242, 202/243, 247, 248, 222, 239, 269
See application file for complete search history.

(56) References Cited

U.S. PATENT DOCUMENTS 4,016,045 A * 4/1977 Van Ackeren ..... 202/242
4,216,061 A * 8/1980 Blase ..... 202/248
4,713,148 A * 12/1987 Offermann ..... 202/248
4,793,900 A * 12/1988 Suey ..... 202/248
4,919,764 A * 4/1990 Baird et al. ..... 202/248
5,254,222 A * 10/1993 Mazzini et al. ..... 202/248
5,395,485 A * 3/1995 Nashan et al. ..... 202/248
5,609,731 A * 3/1997 Giertz et al. ..... 201/35

* cited by examiner

*Primary Examiner*—Glenn Caldarola
*Assistant Examiner*—Alexis Wachtel
(74) *Attorney, Agent, or Firm*—Herbert Dubno; Andrew Wilford

(57) ABSTRACT

A coke oven has a coke-oven chamber adapted to hold a mass of coke, defining above the mass of coke a gas-collecting chamber, and having a door opening. A door closes the door opening. A peripheral gas channel extends around the opening between the door and coke-oven chamber and has at least one outer and at least one inner door seal defining an annular space. The inner door seal is formed in both the coke-oven chamber and the gas-collecting chamber with a plurality of throughgoing holes forming fluid-communicating connections between the coke-oven chamber, the gas-collecting chamber, and the annular space at different heights of the coke-oven chamber and of the gas-collecting chamber. Thus regions of the coke-oven chamber with different gas pressures communicate with each other and with the annular space via the connections on the inner door seal to equalize pressure between the regions and the gas-collecting chamber.

15 Claims, 4 Drawing Sheets

COKE OVEN DOOR WITH GAS CHANNEL

CROSS REFERENCE TO RELATED APPLICATIONS

This application is the US national phase of PCT application PCT/EP00/10324, filed 20 Oct. 2000, published 2 May 2001 as WO 01/30939, and claiming the priority of German patent application 19951467.4 itself filed 26 Oct. 1999 and German patent application 10048678.9 itself filed 30 Sep. 2000.

FIELD OF THE INVENTION

The invention relates to a coke-oven chamber with at least one oven door having a generally complete peripheral gas channel having at least one outer and at least one inner door seal.

BACKGROUND OF THE INVENTION

The crude gases generated in particular at the start of a coking process in a coke-oven chamber as it is being filled are under considerable pressure since gas can only rise with difficulty through the ever deeper mass of coal. This creates the danger that the high-pressure gases will blow through regions of the door seals exposed to this pressure and thus be released. During the coking process the crude gases generated are less as is the likelihood of an escape. Toward the end of the coking operation there is as a result of the reduced generation of gases in the coke-oven chamber a subatmospheric pressure in the lower region of the coke oven. This creates the danger that outside air can be sucked into the coke-oven chamber and damage the oven.

Coke-oven doors are known in many different embodiments that primarily serve to form a gas-tight closure of the coke-oven chamber. German 2,658,196 (US equivalent U.S. Pat. No. 4,016,045) describes a coke-oven door with a complete peripheral channel formed by elastically compressed seal strips. This gas channel communicates with flues of the coke-oven chamber such that draft is created. If only crude gas flows as a result of insufficient sealing into the gas channel, the gases are sucked by the draft action into the flues. Crude gas can therefore leak from the oven chamber into the atmosphere.

As a result of the connection of the flues with the gas channel the pressure relationships of the flues (draft) are present in the gas channel. A constant subatmospheric pressure is created in the gas channel. This leads to an unwanted sucking of crude gas out of the oven chamber and when the outer seal leaks somewhat there is the danger that air is drawn into the gas channel.

OBJECT OF THE INVENTION

It is an object of the invention to avoid emissions and drawing of air into a coke-oven chamber with a seal system that eliminates leaking of crude gases from the coke-oven chamber and that also prevents sucking air into the coke-oven chamber.

SUMMARY OF THE INVENTION

This object is attained in that the inner door seal forms fluid-communicating connections between the coke-oven chamber and the gas channel at different heights of the coke-oven chamber so that regions of the coke-oven chamber with different gas pressures communicate with each other via the connections on the inner door seal and the gas channel to equalize pressure.

The gas channel according to the invention which surrounds the coke-oven door has at least one permanent connection with the coke-oven chamber. Preferably the connection is with the gas-collection space. The crude gas is at superatmospheric pressure in the coke-oven chamber at the start of the coking process. As a result of local pressure peaks the crude gas can get through the inner door seal into the gas channel. There it expands and is no longer able to pass through the other seal. Since the gas channel is connected with the coke-oven chamber the crude gas collecting in the gas channel goes into the coke oven rather than leaking outside. This is also true with leaks in the seal that form unwanted connections at the inner door seal.

In particular, a permanent connection of the gas' channel to the gas-collecting space ensures that the pressure of the gas-collecting space is present in the gas channel. With a tall coke-oven chamber it is advantageous to also provide fluid-communicating connections below the gas-collecting space on the inner door seal.

Local pressure peaks near the door of the coke-oven chamber can thus be lowered quickly.

During the coking operation the crude-gas pressure drops to a subatmospheric pressure (e.g. near the floor of the oven). In this case on the other hand the crude gas can move out of the gas channel through the inner seal into the coke-oven chamber. This has the advantage that no air is sucked into the coke-oven chamber since the gas channel is not filled with air, but with crude gas.

Since the gas channel is not directly connected with the coking coal, it cannot be plugged by the coking coal.

The gas channel is in fluid communication with the coke-oven chamber. It is possible as described above to have the same pressure in the gas channel for equalization purposes as in the coke-oven chamber. This makes it possible to control or influence the gas pressure in the gas channel by chamber-pressure regulation. This can preferably be done with the chamber-pressure regulating system according to German 4,321,676 (US equivalent U.S. Pat. No. 5,609,731). According to this patent, which is herewith incorporated by reference, the pressure of the coke-oven is controlled by a water-level setting using a water-filled cup-shaped flow-restricting element.

It is also possible to control the gas pressure in the gas channel via the overall pressure control of the coke-oven doors together.

The gas channel is preferably mounted on the coke-oven door. It can thus be so set up that it is retrofitted to an existing coke-oven door. Thus it is inexpensive to reduce the emissions of existing coke-oven chambers.

It is also possible to integrate the gas channel in the door frame of the coke-oven chamber. Depending on the actual construction of the coke-oven door the gas channel can have virtually any cross section. It can thus for example be formed as a trapezoid with unequal sides.

The door seals of the gas channel can also have different lip shapes. They can for example have one chamfered side, a grooved shape, or be rounded. The preferred system is the one-sided chamfered embodiment of the door seal. Tests have shown that this wedge-shaped embodiment of the seal lips gives the best sealing characteristics. Here the arrangement of the chamfered side is of particular significance. Preferably the chamfered lips of the inner and outer door seals are toward the higher gas pressure on the respective door seals. In this manner the tar that condenses out is pushed into the wedge and thus improved the sealing capacity of the door seal.

In addition any of the door seal sections known in the coking field can be used.

The pressure applied to the door seals is different for different door latches. With the coke-oven door according to the invention with a gas channel the pressure is split between the two door seals. Thus the distribution of pressure can be such that the inner door seal is more compressed than the outer door sea. This can be necessary because of the higher pressure exerted by the crude gas on the inner door seal.

In order to achieve the best seal effect with the available pressure, the force distribution is determined from case to case. The different force distribution can for example be effected by the seal surface on the elastic door seals of the door frame, that is the door seals are of different lengths on the door frames. The door seals can also be made up with different compressibility, e.g. by shaping or different wall thicknesses.

It is possible to operate the oven door with a gas channel depending on the coking time with a subatmospheric pressure close to 0 mbar in the gas channel at the start of the coking operation and toward the end of the coking operation to eliminate the subatmospheric pressure in the gas channel. In case air has entered into the gas channel there will be no combustion since the combustion conditions for the thus produced gas mixture and the necessary ignition temperatures are not present. Thus the danger of combustion in the gas channel is excluded. In any case no air gets into the oven region filed with coking coal. It will not burn at the oven walls with the resultant damage. In case of an accidental excessive subatmospheric pressure, air sucked into the gas channel will be vented into the gas-collecting space.

According to a further feature of the invention the connections between the coke-oven chamber and the gas channel are provided on the inner door seal with a valve. This valve is constructed such that it can be adjusted steplessly from outside during operation of the oven and can be fully opened or fully closed. By use of the adjustable valve it is possible to influence the gas pressure in the gas channel by opening and closing the valve for each oven door.

In spite of uniform gas-collecting space pressure the coking side and the machine side have different pressures and gas flow is created in the gas channels in the doors. In this manner with different gases being generated and thus different pressures for each oven door it is possible to set the respective valves to control emissions and/or air entry.

Tests have shown that the temperature of the door seals during operation of the oven lies between 100° C. and 200° C. Thus as a result of the tar present on the door seals one gets a highly effective sealing at the door seals.

This temperature range can be achieved by certain steps such as insulating or influencing the transmission of heat through the seals, carrying off the excessive heat by cooling by for example cooling fins, and providing special heat transfer. By the proper combination of insulation, heat conduction, and cooling it is possible to maintain the desired temperature range. To this end it can be necessary to provide different combinations of cooling and insulation at different levels on the coke-oven door.

It is also possible to actively influence the temperature at the door seals. When one region of the door seal goes above 200° C. it can be cooled by feeding in a coolant to drop the temperature by about 100° C. to about 200° C.

The parts described above, claimed, and described by way of example according to the invention can be shaped and made of materials technically designed according to the particular operating conditions so that they meet the specific use requirements and all are covered by the scope of the claims.

BRIEF DESCRIPTION OF THE DRAWING

Further specific details, features, and advantages of the invention are seen in the following description and the attached drawing in which by way of example a preferred embodiment of the oven door is shown. In the drawing.

SPECIFIC DESCRIPTION

Figure 1:
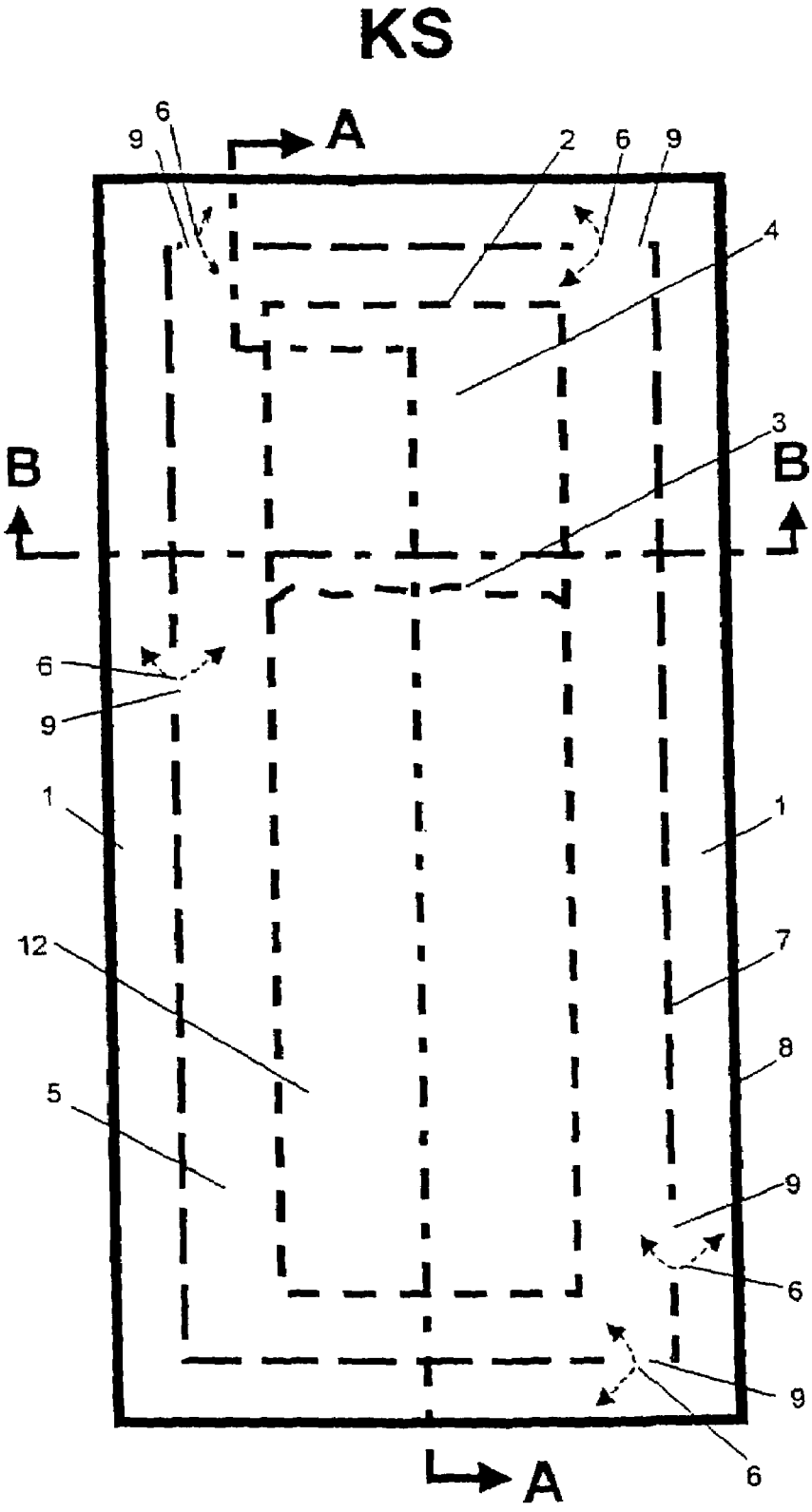
FIG. 1 is a schematic view of the coke-oven door with gas channel seen from outside (direction A of FIGS. 2 and 3)
Figure 2:
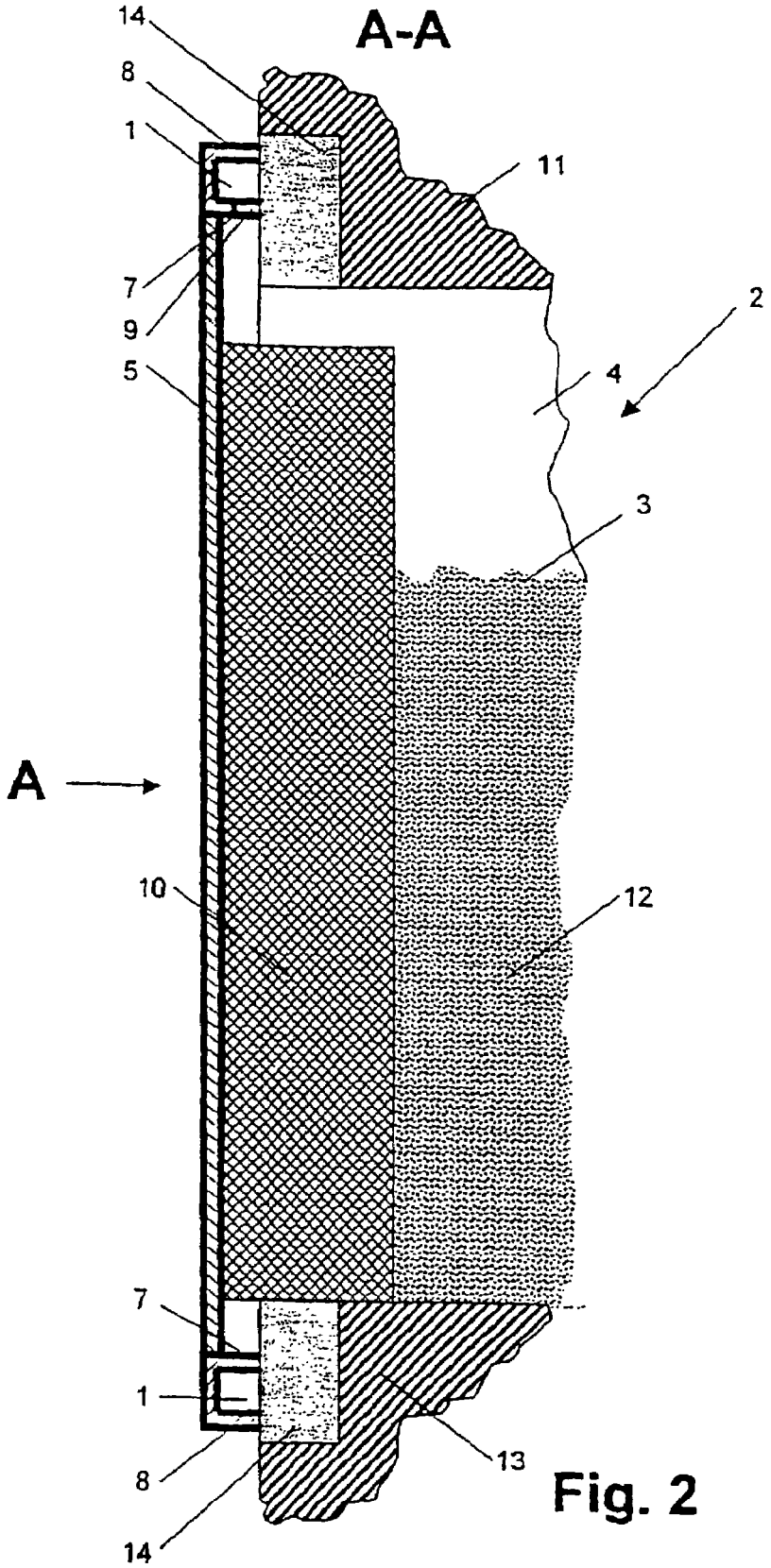
FIG. 2 is section A—A of FIG. 1.

FIG. 1 shows an oven door 5 with a gas channel 1 completely (peripherally) surrounding the oven door 5. The oven door 5 closes a coke-oven chamber 2 on the coking side KS which is filled to a level 3 with coking coal. Above the coal level 3 there is a gas chamber 4. The gas channel 1 is bounded by an inner door seal 7 and an outer door seal 8. They form a U open toward a door frame 14 of the coke-oven chamber 2 and closed by the door frame 14 while the door seals 7 and 8 engage the door frame 14 (FIG. 2). The inner door seal 7 is open at connections 9. Gas can flow through the connections 9 as shown by arrows 6.

FIG. 2 shows the oven door 5 according to section line A—A of FIG. 1. The gas channel 1 surrounds the oven door 5 also in the region of the oven roof 11 and the oven floor 13. The oven door 5 has a door plug 10. The coking coal 12 is filled to the level 3 in the coke-oven chamber 2.

Figure 3:
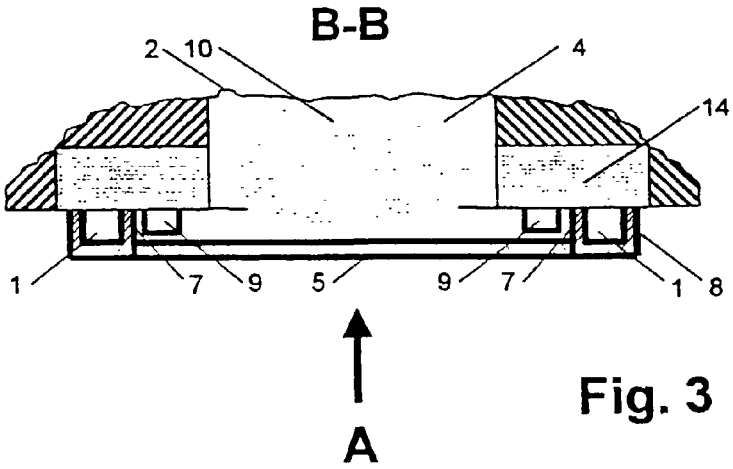
FIG. 3 is section B—B of FIG. 1.

FIG. 3 shows the oven door 5 according to section line B—B of FIG. 1. The gas-collecting chamber 4 communicates via the opening 9 with the gas channel 1. The reference numerals are the same as in the preceding figures.

Figure 4:
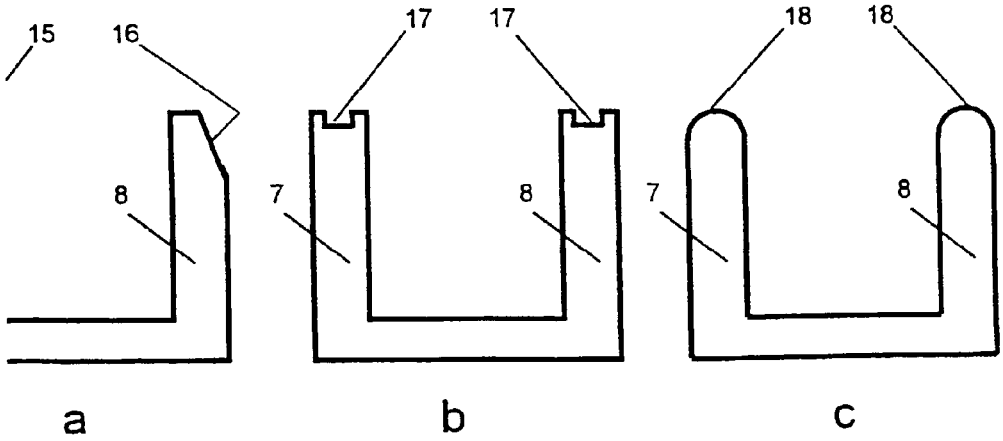
FIG. 4 are various door-seals with gas channels in section.

FIG. 4 shows various sections for the door seals 7 and 8 of the gas channel 1. According to FIG. 4*a* the door-seals are chamfered. They have bevels 15 and 16. FIG. 4*b* shows door seals 7 and 8 with grooves 17. According to FIG. 4*c* the door seals 7 and 8 have rounded edges 18.

Figure 5:
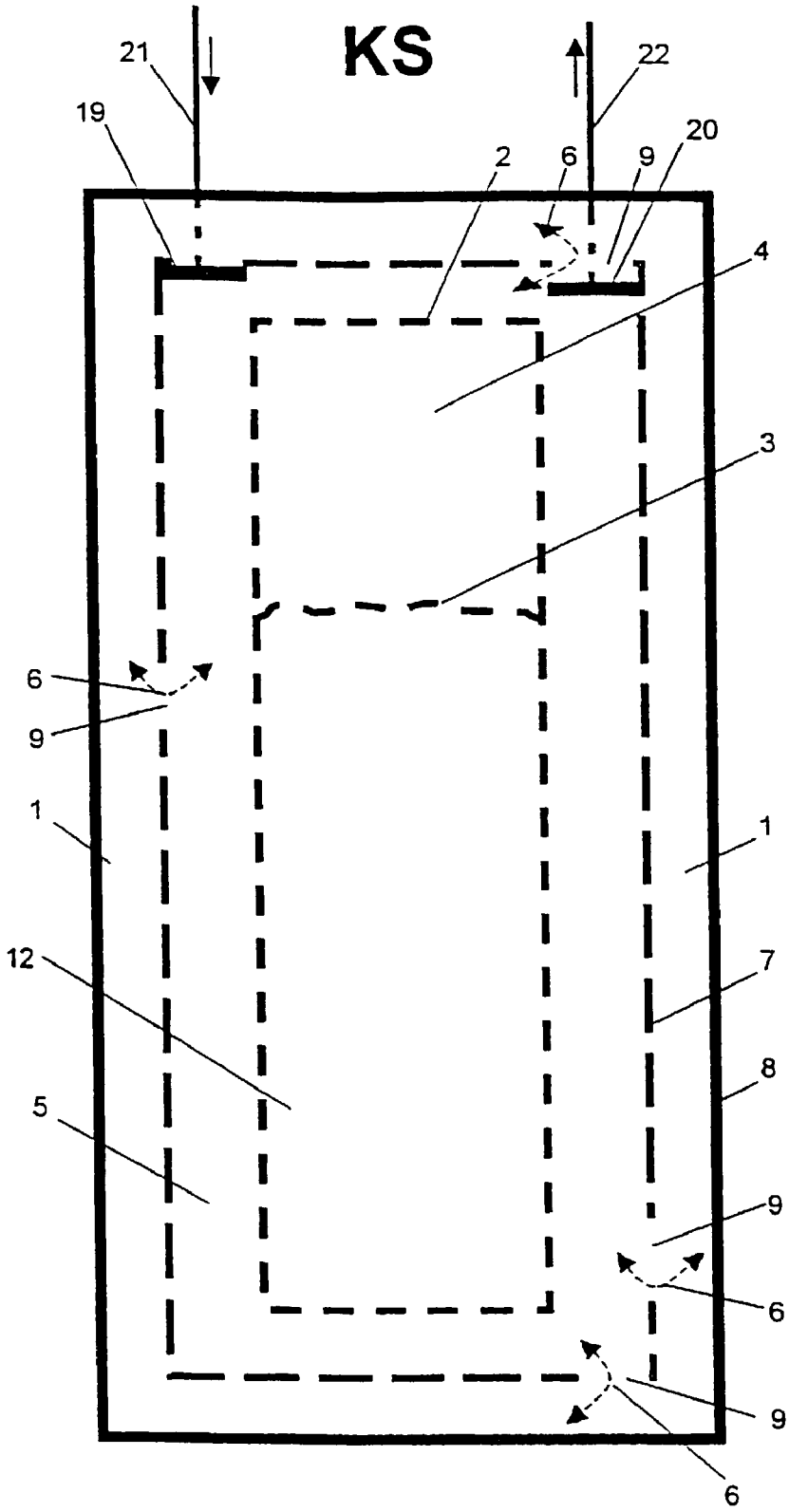
FIG. 5 shows a valve in the flow connection of the inner door seal.

FIG. 5 shows the system of FIG. 1 with restriction of the connections 9. The connections 9 in the upper region of the gas channel 1 are each provided with a valve 19 and 20. The valves 19 and 20 have actuators 21 and 22 that allow the valves 19 and 20 to be controlled from outside. The valve 19 is shown closed. The valve 20 is open, that is gas can flow unhindered through its connection 9.

The invention claimed is:

1. A coke oven comprising:

a coke-oven chamber adapted to hold a mass of coke, defining above the mass of coke a gas-collecting chamber, and having a door opening;

at least one oven door closing the door opening; and a peripheral gas channel extending around the opening between the door and coke-oven chamber and having at least one outer and at least one inner door seal defining an annular space, the inner door seal being formed in both the coke-oven chamber and the gas-collecting chamber with throughgoing holes forming fluid-communicating connections between the coke-oven chamber, the gas-collecting chamber, and the annular space at different heights of the coke-oven chamber and of the gas-collecting chamber so that regions of the coke-oven chamber with different gas pressures communicate with each other and with the annular space via the connections on the inner door seal to equalize pressure between the regions and the gas-collecting chamber.

2. The coke-oven chamber according to claim 1 wherein the gas channel is formed on the oven door.

3. The coke-oven chamber according to claim 1 wherein the gas channel is integrated in a door frame surrounding the opening.

4. The coke-oven chamber according to claim 1 wherein the gas channel is retrofitted on an existing oven door.

5. The coke-oven chamber according to claim 1 wherein the door seals of the gas channel have chamfered lips.

6. The coke-oven chamber according to claim 1 wherein the door seals have lips formed with grooves.

7. The coke-oven chamber according to claim 1 wherein the door seals have rounded edges.

8. The coke-oven chamber according to claim 1 wherein the door seals are elastic and of different lengths.

9. The coke-oven chamber according to claims 1 wherein the door seals are of different wall thicknesses.

10. The coke-oven chamber according to claim 1 wherein the fluid-communicating connections of the inner door seal have at least one valve.

11. The coke-oven chamber according to claim 1 wherein the door seals are cooled by cooling fins.

12. The coke-oven chamber according to claim 1 wherein the door seals are thermally insulating.

13. The coke-oven chamber according to claim 1 wherein a supply of a coolant is connected to the door seals.

14. A method of controlling the gas pressure of a coke-oven chamber with at least one oven door and a generally complete peripheral gas channel having at least one outer and at least one inner door seal wherein the known control of the gas pressure of the coke-oven chamber is used with a U-shaped riser tube having a cup-shaped water-filled restricting element.

15. The method according to claim 14 wherein the gas channel is at subatmospheric pressure.

* * * * *